US009714766B2

(12) United States Patent
Bunting, Jr. et al.

(10) Patent No.: US 9,714,766 B2
(45) Date of Patent: Jul. 25, 2017

(54) SYSTEM FOR GASIFYING BIOMASS AND OTHER WASTE

(75) Inventors: Wiley Benjamin Bunting, Jr., Oak City, NC (US); David C. Mayer, Hobgood, NC (US); Seba Leonard Allen, Pinetops, NC (US)

(73) Assignee: Leggett of Edgecombe County, LLC, Rocky Mount, NC (US)

( * ) Notice: Subject to any disclaimer, the term of this patent is extended or adjusted under 35 U.S.C. 154(b) by 1305 days.

(21) Appl. No.: 13/155,482

(22) Filed: Jun. 8, 2011

(65) Prior Publication Data

US 2012/0312204 A1 Dec. 13, 2012

(51) Int. Cl.

| | |
|---|---|
| ***F23G 5/12*** | (2006.01) |
| ***F23L 13/06*** | (2006.01) |
| ***F23M 5/00*** | (2006.01) |
| ***F23N 3/00*** | (2006.01) |
| ***F23N 3/04*** | (2006.01) |
| ***F23G 5/027*** | (2006.01) |
| ***F23G 5/14*** | (2006.01) |
| ***F23G 5/48*** | (2006.01) |

(52) U.S. Cl.

CPC ..... *F23L 13/06* (2013.01); *F23G 5/0273* (2013.01); *F23G 5/14* (2013.01); *F23G 5/48* (2013.01); *F23M 5/00* (2013.01); *F23N 3/007* (2013.01); *F23N 3/045* (2013.01); *F23G 2201/303* (2013.01); *F23G 2201/304* (2013.01); *F23M 2900/05004* (2013.01)

(58) Field of Classification Search

USPC ..... 110/229, 194, 338, 295, 251, 252, 190

See application file for complete search history.

(56) References Cited

U.S. PATENT DOCUMENTS

| | | | | |
|---|---|---|---|---|
| 1,544,323 | A * | 6/1925 | Kener, Jr. | 110/252 |
| 2,081,935 | A * | 6/1937 | Jones | 501/85 |
| 2,592,730 | A * | 4/1952 | Perkins | 110/229 |
| 4,321,878 | A * | 3/1982 | Segrest | 110/194 |
| 4,498,909 | A | 2/1985 | Milner et al. | |
| 4,603,644 | A * | 8/1986 | Brookes | 110/194 |

(Continued)

*Primary Examiner* — Jason Lau

(74) *Attorney, Agent, or Firm* — Coats & Bennett, PLLC

(57) ABSTRACT

A gasifier for disposing of biomass and other waste materials through a gasification and combustion process. The gasifier includes a primary chamber for receiving and holding biomass or a selected waste product. A heat transfer chamber is disposed adjacent the primary chamber. A burner is associated with the gasifier for generating heat and heating the gasifier during various phases or portions of the gasification and combustion process. In the gasification process, the heat transfer chamber is heated and the heat is transferred to the primary chamber where the biomass is heated. During the gasification process, biomass material is volatized generating fumes and gases that later react and release heat through exothermic reactions. Once the gasification process has been concluded, the process enters a combustion phase where the biomass is actually burned. During the gasification-combustion phases, the amount of heat supplied by the burner will vary. Generally the amount of energy or heat supplied by the burner will decrease throughout the process because the biomass itself will supply substantial amounts of heat through exothermic reactions.

11 Claims, 7 Drawing Sheets

(56) References Cited

U.S. PATENT DOCUMENTS

| | | | | |
|---|---|---|---|---|
| 5,611,289 | A | 3/1997 | Brookes | |
| 5,875,722 | A * | 3/1999 | Gosselin et al. | 110/345 |
| 6,729,247 | B2 * | 5/2004 | Brown et al. | 110/341 |
| 6,808,543 | B2 | 10/2004 | Paisley | |
| 6,948,436 | B2 | 9/2005 | Mooney et al. | |
| 7,763,088 | B2 | 7/2010 | Feldmann | |
| 7,814,845 | B2 | 10/2010 | Brookes | |
| 2006/0107595 | A1 | 5/2006 | Davison et al. | |
| 2006/0196398 | A1 * | 9/2006 | Graham | 110/267 |
| 2008/0072807 | A1 * | 3/2008 | Brookes | 110/346 |
| 2008/0308017 | A1 * | 12/2008 | Brookes | 110/212 |
| 2009/0188347 | A1 * | 7/2009 | Taber et al. | 75/301 |
| 2009/0266081 | A1 | 10/2009 | Graham | |

* cited by examiner

SYSTEM FOR GASIFYING BIOMASS AND OTHER WASTE

FIELD OF THE INVENTION

The present invention relates to gasifiers and more particularly to a gasifier designed to gasify biomass and other waste products.

BACKGROUND

Gasifiers are widely used to dispose of biomass such as dead animals, dead humans and materials and things that have been subjected to bacteria, viruses and other disease causing constituents. It is the principal object of a gasifier dealing with such biomass to reduce the biomass to ashes. More particularly, it is desirable to rid the biomass of any carbon and therefore the idea is to employ a process that produces white ashes as opposed to black ashes that suggest that there is remaining carbon in the ashes.

Generally, gasifiers include a primary chamber and a secondary or heat transfer chamber. A burner is utilized to heat inlet air that in turn heats the heat transfer chamber, which in turn heats the primary chamber. Many gasification processes can be divided into two phases, a gasification phase and a combustion or carbon phase. In the gasification phase, the biomass is heated in such a fashion that moisture is removed from the biomass. Once the moisture has been removed or substantially removed from the biomass, the process moves to the combustion process where the biomass actually burns and produces a flame. In both the gasification and combustion process, the biomass emits combustible gases that can be recirculated to the burner and burned or which under go exothermic reactions and produce heat. This makes many gasifier systems fuel efficient. Indeed, in some cases or in some phases of an gasification process, the gases or fumes given off by the biomass are sufficient to support the heat requirements of the process.

It is the aim of such gasification processes to heat the biomass so that the biomass is converted to harmless gases such as hydrogen and oxygen which oxidize to form water vapor and carbon dioxide and other harmless constituents.

SUMMARY OF THE INVENTION

The present invention relates to a gasifier for gasifying and burning biomass and other waste materials. The gasifier comprises a primary chamber for receiving and holding the waste to be gasified or burned and a heat transfer chamber disposed underneath the primary chamber. A burner is provided for supplying heat to the gasifier and wherein the burner is operative to heat the heat transfer chamber which in turn heats the primary chamber and the waste therein.

In one particular embodiment, the gasifier comprises one or more adjustable air flow vents for varying the quantity of fresh air directed into the gasifier. The adjustable air flow vents can be actuated or moved manually, or in another design, there is provided a processor that is operatively connected to an actuator that in turn is connected to the adjustable air flow vents for actuating the same and hence varying the air flow into the gasifier.

In another exemplary embodiment, the gasifier of the present invention is provided with a control system for controlling various phases of an gasification process. In one example, the control system includes a processor and one or more temperature sensors strategically disposed within the gasifier. By sensing temperature, the processor is able to particularly control the inlet air flow into the primary chamber so as to efficiently perform a gasification process and thereafter to efficiently perform a combustion process where the biomass is burned.

Another feature of the present invention entails the use of two distinct types of refractory bricks utilized in opposing side walls of the primary chamber. In one case, a lower section of the opposed side walls comprises refractory bricks that are more resistant to wear and abrasion than an upper section of refractory bricks that also form a part of the side walls of the primary chamber. The upper section of refractory bricks on the other hand is generally more porous and has better insulating qualities than the lower section which as stated comprise bricks that are more durable and which resist wear and abrasion.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, the gasifier of the present invention is shown therein and indicated generally by the number 10. Gasifier 10 is designed to gasify various waste products. In one application the gasifier 10 is utilized as a gasifier for biomass. As will be explained in greater detail subsequently herein, in disposing of biomass, the gasifier 10 is utilized during a first phase to carry out a gasification process. During this process the biomass is volatized and moisture is removed from the biomass and this results in the production of gases that are utilized by the gasifier 10 as a source of fuel and heat. In a second phase of this process, there is combustion. That is, the biomass itself starts to burn (produces a flame) and during this process the gasifier 10 is effective to completely gasify the biomass in a process that is environmentally safe and clean.

Figure 1:
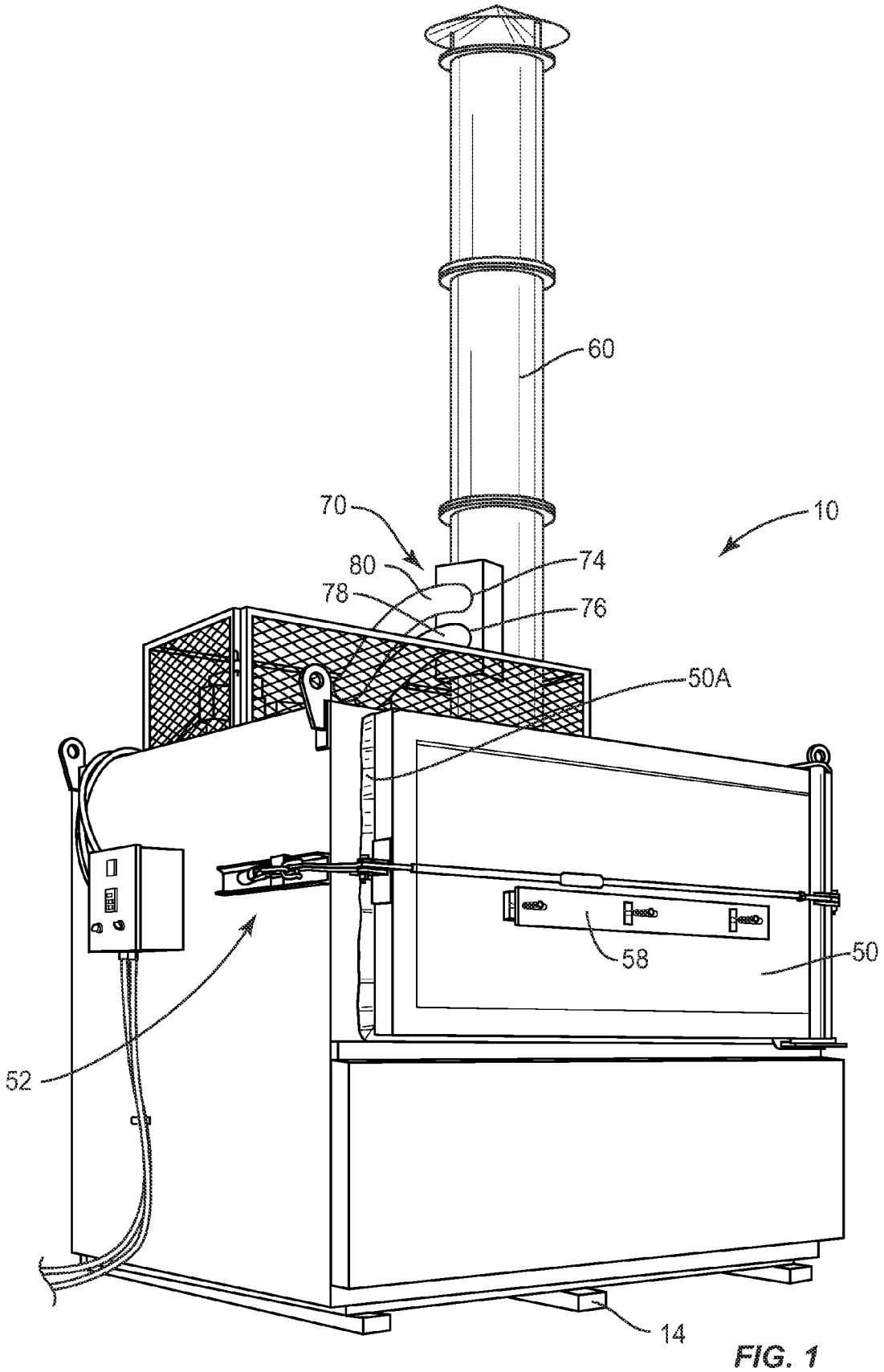
FIG. 1 is a perspective view of the gasifier.
Figure 3:
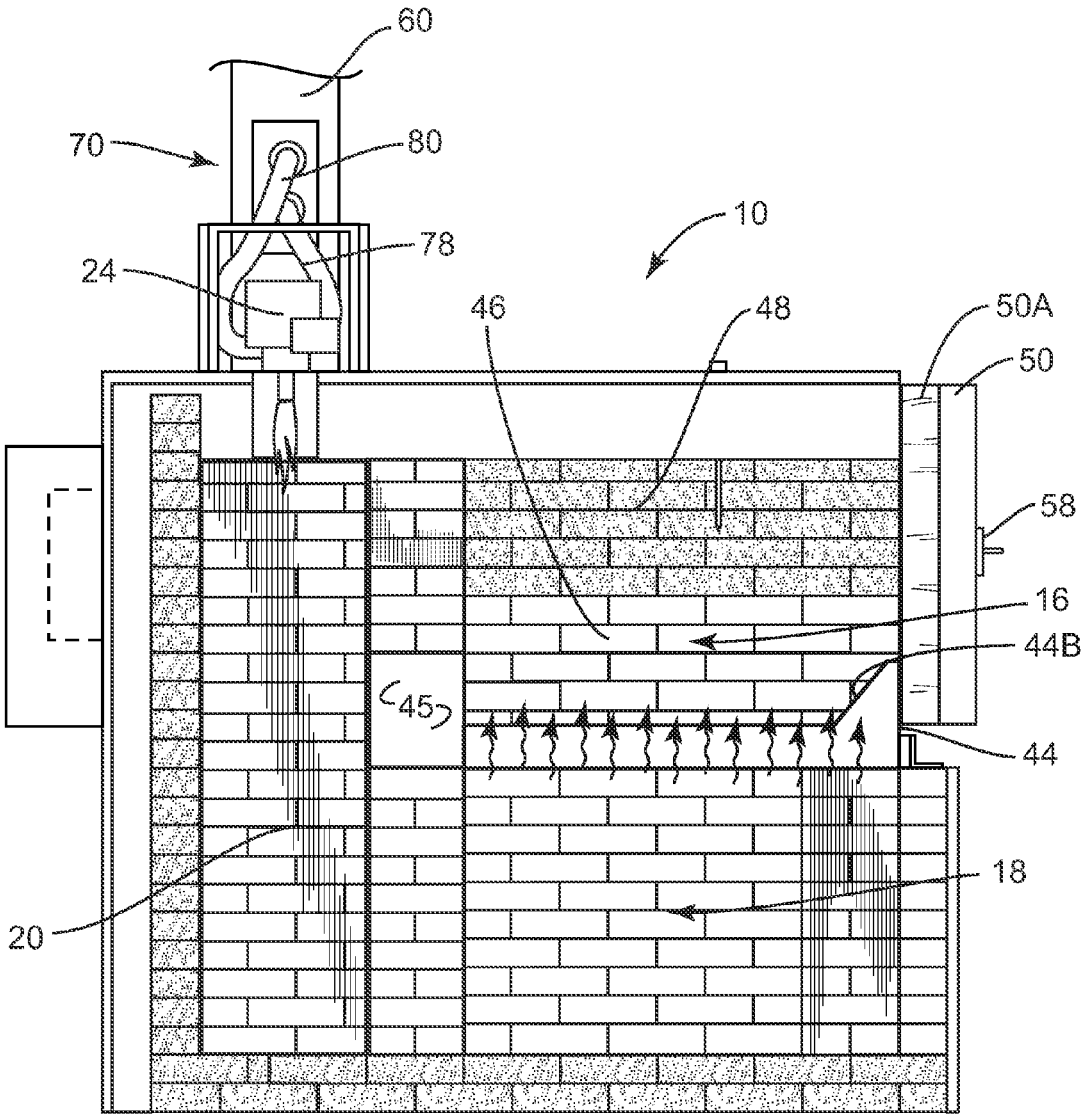
FIG. 3 is a side sectional view of the gasifier illustrating the primary chamber, the secondary chamber and the vertical heating chamber.
Figure 5A:
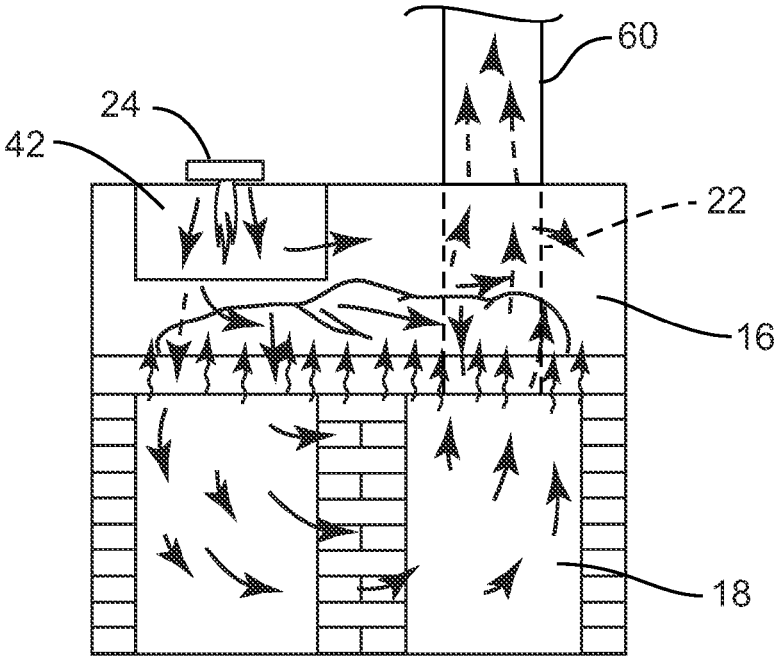
FIG. 5A is a schematic illustration showing air and gas flow through the gasifier during a gasification phase.
Figure 5B:
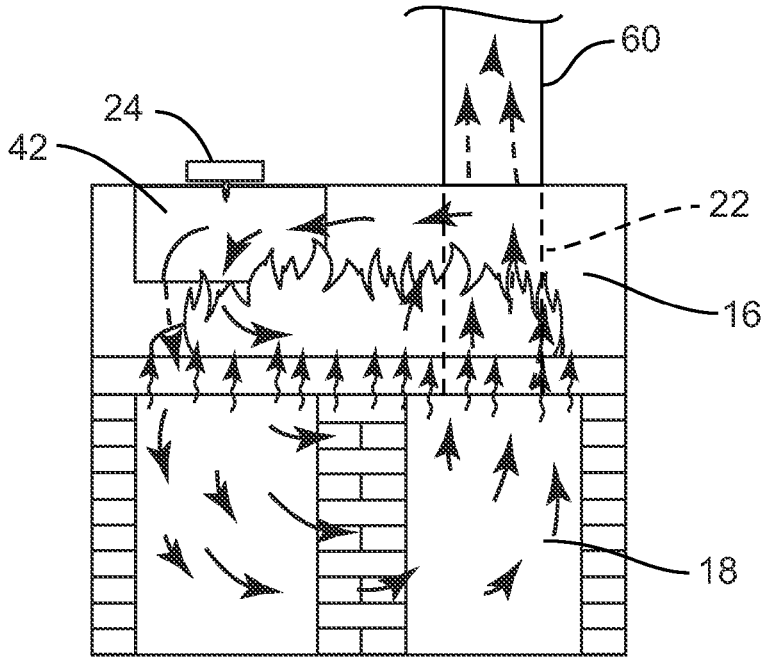
FIG. 5B is similar to FIG. 5A but shows the process during a combustion phase.

Turning to a more detailed discussion of the structure and design of the gasifier 10, as viewed in FIG. 1, the gasifier includes a housing 12. Housing 12 includes a mainframe that includes a base 14. Base 14 is designed to enable the gasifier 10 to be easily picked up and moved from one location to another. Gasifier 10 includes a primary chamber indicated generally by the numeral 16. Primary chamber 16 is configured to receive and support the waste product that is to be gasifyd. Disposed below the primary chamber 16 is a heat transfer or secondary chamber 18. As will be appreciated from subsequent portions of this disclosure, the heat transfer chamber 18 is effective to transfer heat therefrom to the above disposed primary chamber 16. In addition to the primary chamber 16 and the heat transfer chamber 18, there are two other vertical chambers disposed in the gasifier 10. First there is a vertical heating chamber 20. As seen in FIG. 3, the vertical heating chamber 20 is disposed on one side and behind the primary chamber 16 and extends downwardly where it communicates with the heat transfer chamber 18. There is also a vertical exhaust chamber 22 that is disposed to one side of the vertical heating chamber 20. See, for example, FIGS. 5A and 5B.

Mounted on the top of housing 12 of the gasifier 10 is a burner 24. In this embodiment, burner 24 is a gas fired burner and includes a fan motor and an air inlet associated therewith. Note in FIG. 3 where the burner 24 is disposed above the vertical heating chamber 20. When burner 24 is fired, the flame of the burner projects downwardly and projects into the vertical heating chamber 20. As will be appreciated from subsequent portions of the disclosure, the burner 24 is utilized to heat the gasifier and in particular is utilized to heat the heat transfer chamber 18 and the primary chamber 16. Furthermore, the burner 2 is strategically positioned in the gasifier to burn gases or fumes emitted from the biomass or other waste material being gasifyd in the primary chamber 16. That is, as the biomass or other waste product is gasified or burned in the primary chamber, fumes or combustible gases will be emitted from the biomass or waste product and these fumes or gases are channeled in such a fashion that they pass in proximity of the burner 24 which can ignite and burn a majority of these gases and particulates.

Figure 2:
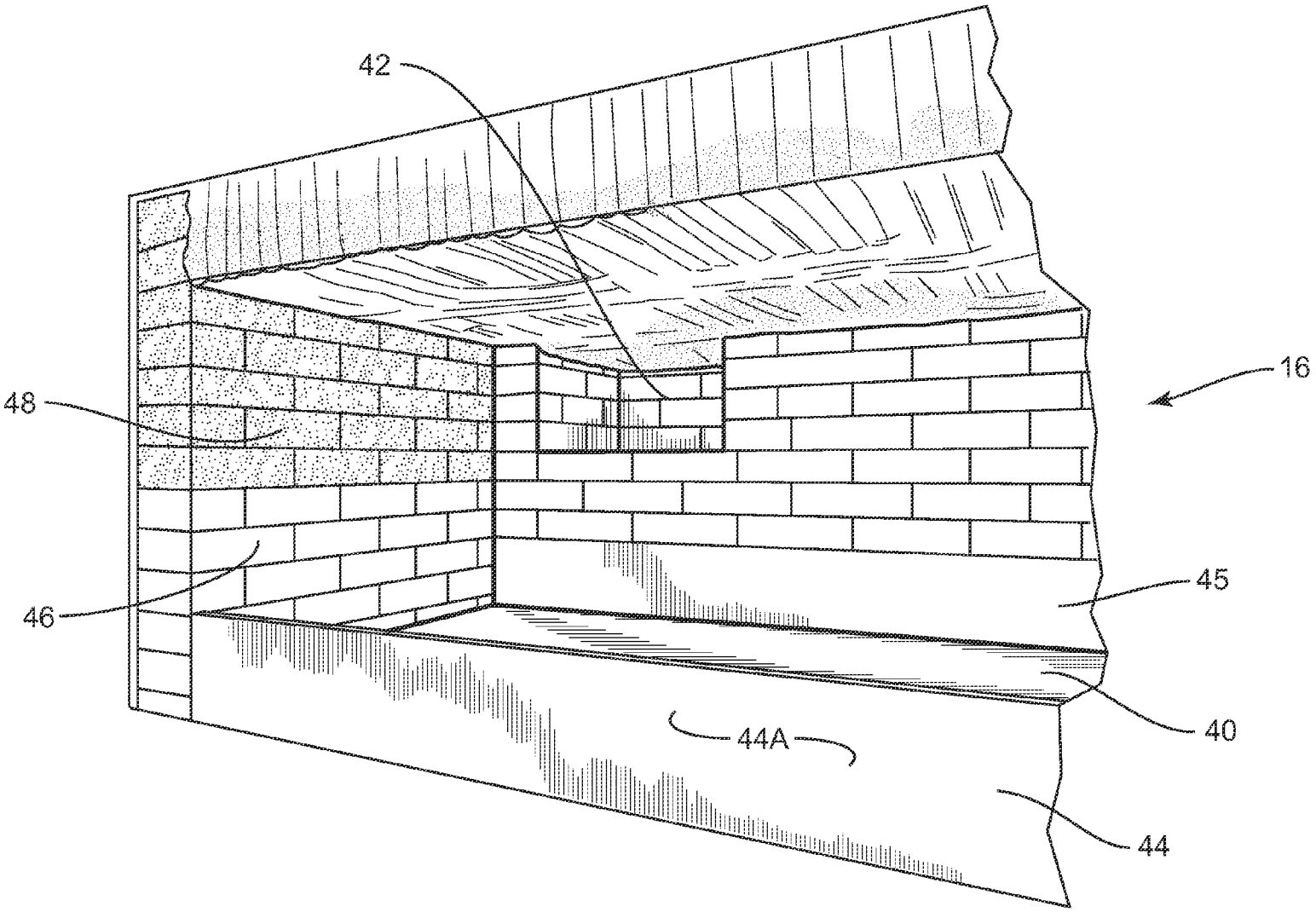
FIG. 2 is a fragmentary perspective view showing a portion of the primary chamber.

Now turning to a discussion of the primary chamber 16, FIG. 2 shows the primary chamber. Note that the primary chamber 16 is disposed about an upper front portion of the gasifier 10. As noted above, the vertical heating chamber 20 and the vertical exhaust chamber 22 extend behind the primary chamber 16. The primary chamber 16 includes a conductive floor 40. Conductive floor 40 can be constructed of various materials. In one exemplary construction, the floor is constructed of a combination of silicon carbide and conventional mortar. As seen in FIG. 2, the primary chamber 16 includes two side walls, a back wall and a top. Further, the primary chamber 16 includes a front access opening. Formed in the back wall is an opening 42. Opening 42 formed in the back wall of the primary chamber 16 is also open to the vertical heating chamber 20. That is, the gases or fumes emitted from the biomass or waste product can move from the primary chamber 16 through the opening 42 and into the vertical heating chamber 20. Furthermore, the burner 24 is positioned with respect to the vertical heating chamber 20 such that the flame during portions of the gasification process projects downwardly through the vertical heating chamber 20 and can be seen from the primary chamber 16. Thus the flame from the burner 24 is not blocked from the primary chamber 16. In fact the flame provides radiant heat through the opening 42 to the biomass located in the primary chamber 16.

A beam structure 45 extends transversely across the lower back portion of the primary chamber 16. See FIGS. 2 and 3. This beam structure 45 is constructed of a heavy duty mortar structure that is design to withstand high temperatures that are traditionally experienced in conventional gasifiers. Note that the beam structure 45 includes a face that is exposed in the primary chamber. Because of the construction of the beam structure 45, the face thereof can withstand wear and tear from shovels and other implements that are used in cleaning the primary chamber. Also, note in FIG. 3 where the beam structure 45 supports the wall that extends upwardly therefrom.

Disposed about the lower front of the primary chamber 16 is a retainer 44. In some embodiments, the retainer 44 is constructed of the same material as the conductive floor 40. As alluded to above, one construction for the conductive floor 40 and the retainer 44 is a silicon carbide-mortar construction. In any event, retainer 44 includes a face 44A and an inclined back surface 44B. See FIG. 3. Note that the inclined back surface 44B extends at an angle downwardly and inwardly towards the conductive floor 40. Retainer 44 functions to retain grease and other material that is produced during the gasification or combustion process.

The primary chamber 16 has a unique side wall structure. As seen in FIG. 2, the sides of the primary chamber include two distinct sections of refractory bricks. There is a lower or first section of refractory bricks that are referred to by the numeral 46. Disposed over the lower section of refractory bricks 46 is an upper or second section of refractory bricks 48. These two sections of refractory bricks have different physical and performance characteristics. In particular, the first or lower section of refractory bricks 46 is more durable than the second or upper section of refractory bricks 48. That is, the first section of refractory bricks 46 are more wear and abrasion resistant than the second section of refractory bricks 48. On the other hand, the upper section of refractory bricks 48 is more porous than the lower section of refractory bricks 46. In particular, the upper section of refractory bricks 48 has better insulating qualities than the lower section of refractory bricks 46.

Secured to the front of the gasifier 10 is a door 50. Door 50 is movable between open and close positions. In the closed position, shown in FIG. 1, the door 50 closes the primary chamber 16. Extending at least around the inside perimeter of the door 50 is a sealing member 50A. The sealing member 50A can be various types of materials that are at least slightly pliable and which will form an airtight seal when the door is in the closed position. There is provided an over-center latch 52 for securely latching the door 50 in the closed position.

Formed in the door is a system or mechanism for varying air flow directly into the primary chamber 16. This system or mechanism includes a series of flow vents having adjustable size openings. In particular, formed in the door 50 is a series of openings 54. See FIGS. 7A and 7B. An interface 56 extends along the face of the door and around the openings 54. A slide bar 58 is slidably mounted on the interface 56. Slide bar 58 includes a series of openings 58A that are designed to align with the openings 54 in the door or partially align with the openings in the door. As will be appreciated from FIGS. 7A and 7B, in one position, the slide bar 58 is effective to close the openings 54 in the door.

Slide bar 58 includes a series of slots 58B. A series of studs 59 project outwardly from the door 50 or interface 56 through the slots 58B. A spring 61 is disposed around each stud 59 and is retained on the stud in such a manner that the springs engage the slide bar and effectively bias the slide bar against the interface 56. Effectively, the studs 59 and springs 61 hold the slide bar firmly against the interface.

Figure 7A:
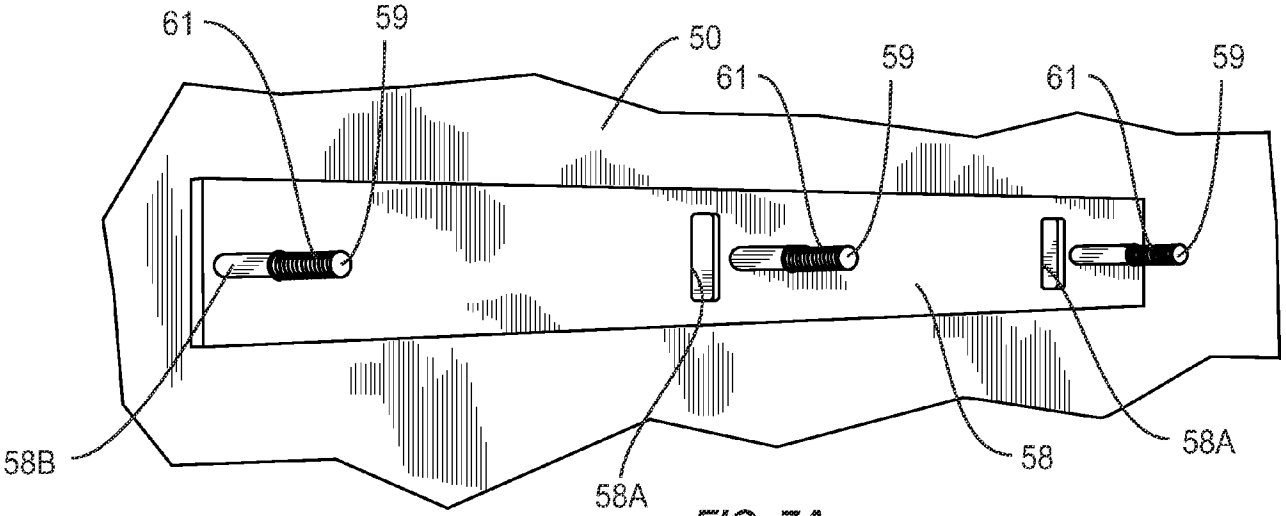
FIG. 7A is a fragmentary perspective view showing the adjustable air flow vents that form a part of the door of the gasifier with the air flow vents being shown in a closed position.
Figure 7B:
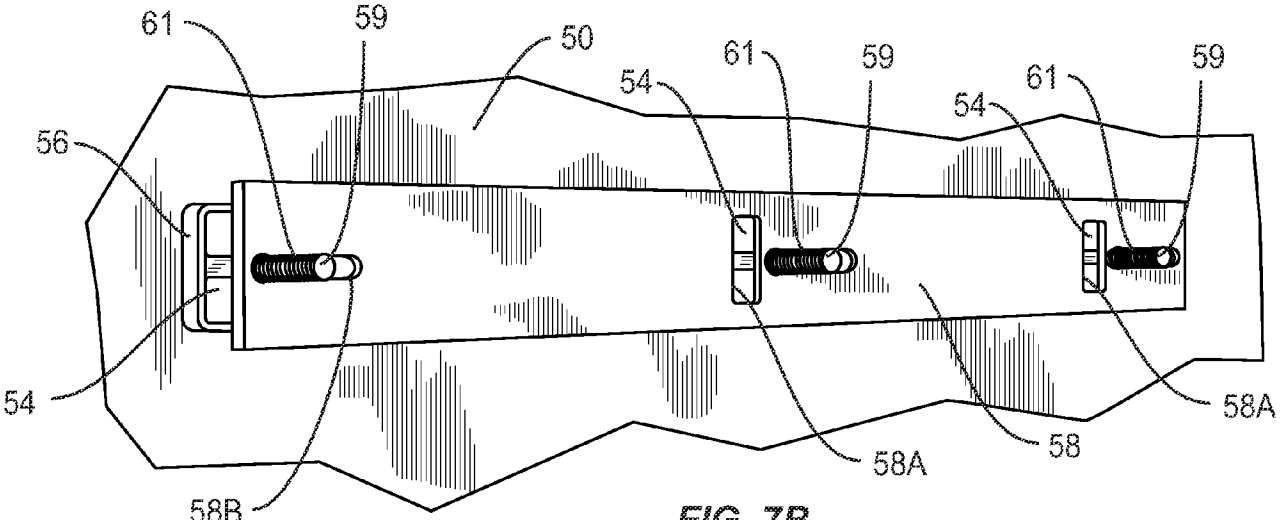
FIG. 7B is similar to FIG. 7A but wherein the air vents are open such that air can be induced through the air vents and into the primary chamber.

In FIG. 7A the slide bar 58 is positioned such that all of the openings 54 in the door 50 are closed. FIG. 7B shows the slide bar 58 moved slightly to the right and in this position the openings 54 in the door are effectively opened via the openings 58A and the slide bar. By slightly adjusting the position of the slide bar 58, the effective open area of the respective openings 54 can be varied.

Disposed underneath the primary chamber 16 is the heat transfer chamber 18. Heat transfer chamber 18 functions in substantial part to heat the primary chamber 16. The heat transfer chamber 18 is open to or communicatively connected to both the vertical heating chamber 20 and the vertical exhaust chamber 22. As seen in FIG. 3, the heat transfer chamber is substantially made up of refractory bricks that will withstand the high temperatures commonly encountered in gasifiers and gasifiers.

Extending upwardly from the top of the gasifier 10 is an exhaust flue 60. See FIG. 2. Exhaust flue 60 is communicatively connected to the vertical exhaust chamber 22 that extends upwardly on one side and behind the primary chamber 16. The function of the exhaust flue 60 is to exhaust gases from the gasifier 10.

The burner 24 includes a fan motor associated therewith and an air inlet. The fan is operative to pull fresh inlet air into the gasifier 10 and particularly to pull or induce air into the burner 24 to facilitate combustion. It should be noted that gasifiers generally operate in the absence of substantial oxygen. Therefore, the air induced by the fan motor associated with the burner 24 is for the purpose of supplying oxygen to support the burner. In addition, the gasifier 10, shown in FIG. 4, includes an auxiliary inlet air fan 82. Auxiliary fan 82 functions to induce a separate stream of air into the gasifier.

Figure 4:
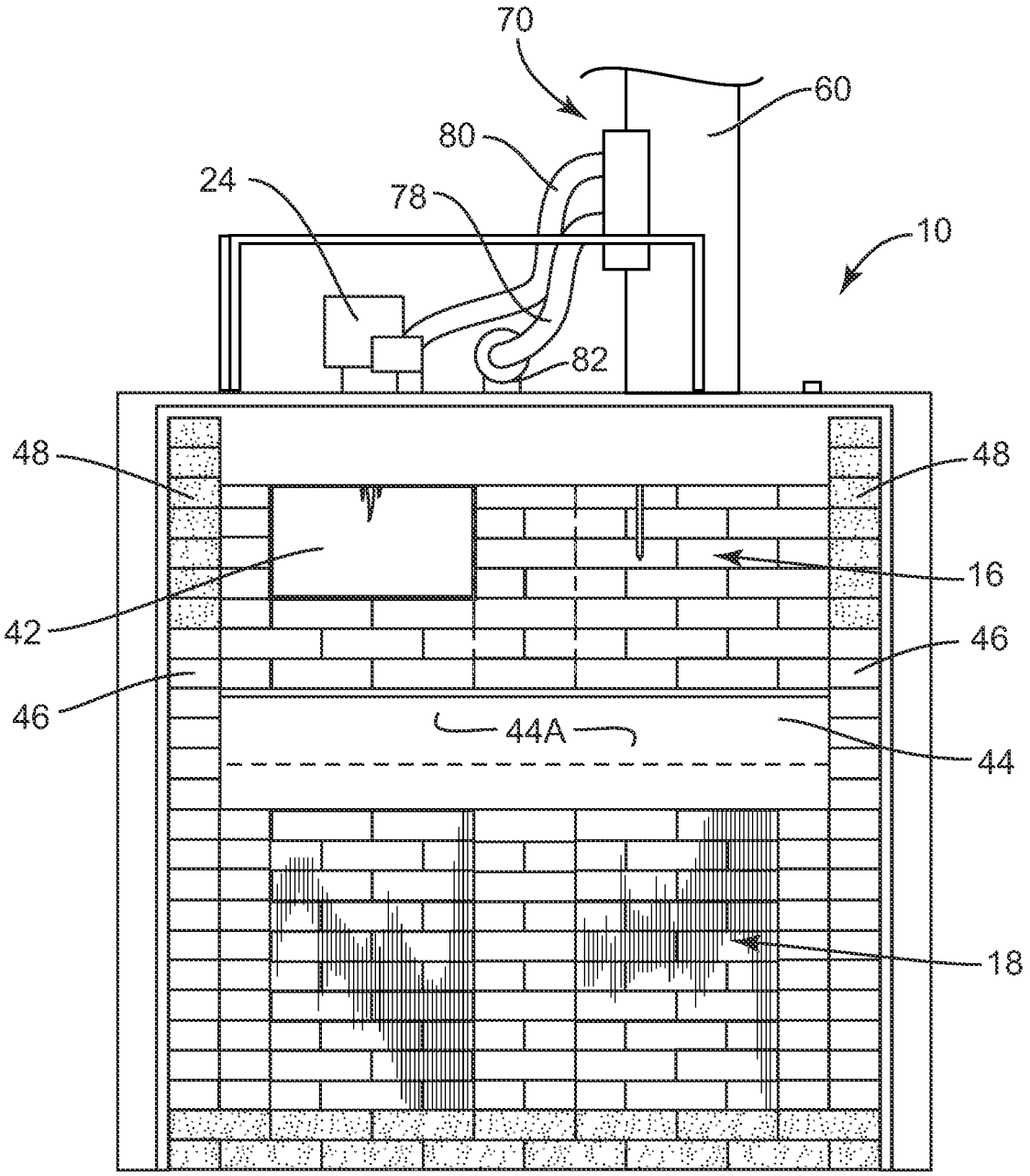
FIG. 4 is a front sectional view showing the primary chamber open at the front.

There is provided a heat exchanger, indicated generally by the number 70, for preheating the inlet air that is directed to the burner 24 and to the auxiliary fan 82. The heat exchanger 70 is shown in FIGS. 1, 3 and 4. As shown in the drawings the heat exchanger 70 includes a housing 72. Housing 72 is bolted or secured by other suitable means to the exhaust flue 60. Housing 72 includes an interior area or space adjacent the exterior of the exhaust flue 60. In addition, the housing 72 is open at the top or at other areas to allow inlet air to pass into the housing and into the space between the housing and the exhaust flue. Formed in the housing 72 are two outlet openings 74 and 76. There is provided a conduit 78 that is connected to the lower outlet 76 and wherein the conduit 78 extends from the heat exchanger 70 to the auxiliary fan 82. There is a second conduit 80 that extends from the upper outlet 74 of the housing 72 to the burner 24. Thus, the auxiliary fan 82 and the fan associated with the burner 24 are operative to induce air into the heat exchanger 70. More particularly, these fans induce air into the area or space between the housing 72 and the exhaust flue 60. Because the exhaust gases being directed out exhaust flue 60 are very hot, it follows that the inlet air induced into the heat exchanger 70 is effectively heated by the exhaust gases being exhausted by the exhaust flue. This preheated air is in turn directed via conduits 78 and 80 to the auxiliary fan 82 and the burner 24.

Figure 6:
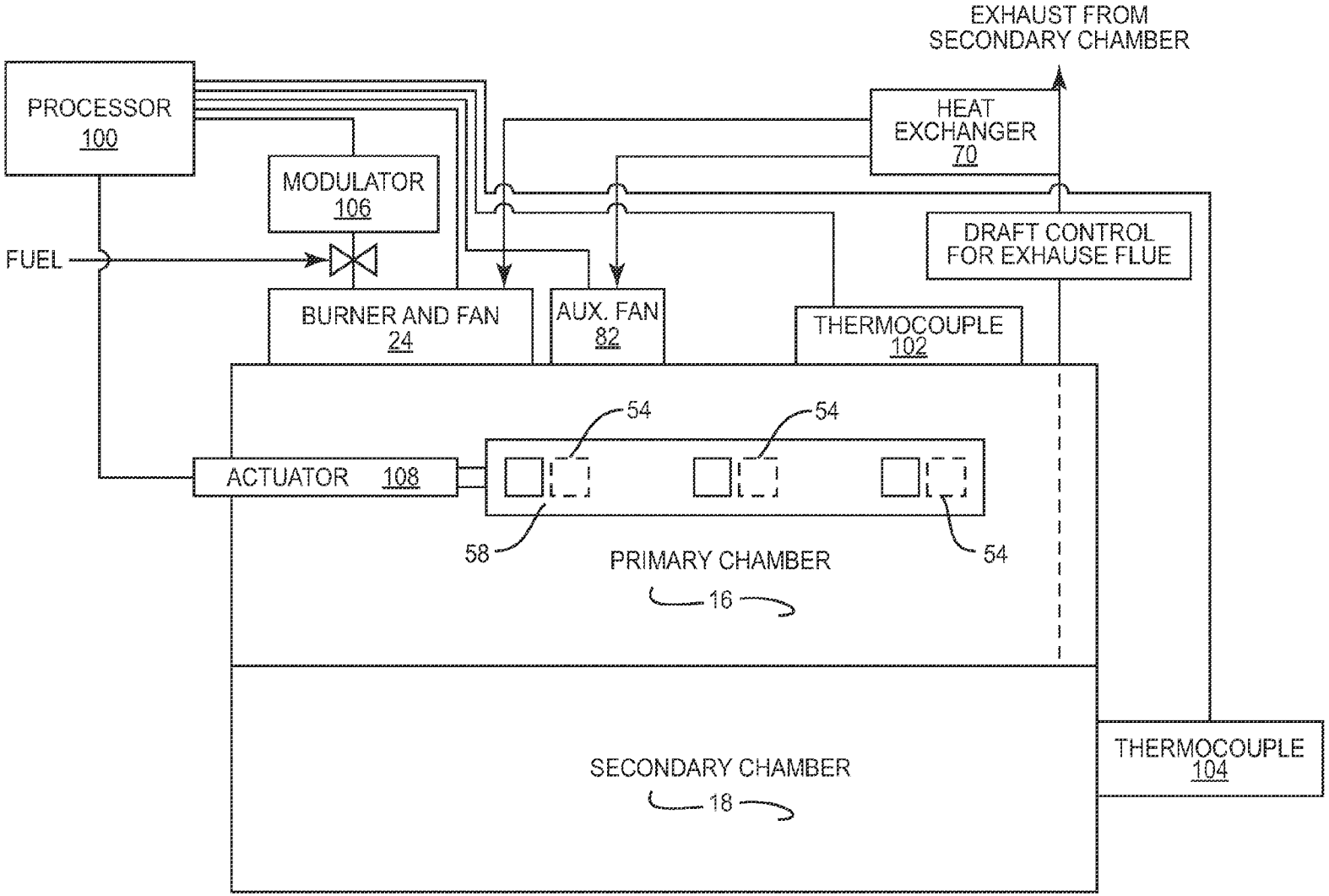
FIG. 6 is a schematic illustration showing an automatic control system for the gasifier.

Gasifier 10 can be provided with a control system for controlling gasification and combustion processes as well as the overall gasifier process. An exemplary control system is shown in FIG. 6. This control system comprises a processor 100 and a plurality of temperature sensors strategically placed in the gasifier 10. In the example illustrated in FIG. 6, the temperature sensors include thermocouples 102 and 104. While the temperature sensors or thermocouples can be placed in various parts of the gasifier 10 to efficiently control the gasification process, in the example shown in FIG. 6 the thermocouple 102 is disposed in the primary chamber 16 and the thermocouple 104 is disposed in the heat transfer chamber 18. Both thermocouples 102 and 104 are operatively connected to the processor 100 and are operative to direct temperature control signals into the processor. There is also provided a modulator 106 that is operatively associated with the burner 24. The modulator 106 is operatively connected to the processor 100 and is operative to control a modulating valve for modulating the flow of fuel into the burner 24. Thus it is appreciated that the processor 100 can be effective to control the flow of fuel to the burner 24 in the process of controlling the temperature within the gasifier 10. There is also provided an actuator (such as a linear actuator) 108 for controlling the slide bar 58 of the variable air flow vents. Details of the modulator 106 and the actuator 108 are not dealt with herein in detail because they are not per se material to the invention and further, such modulators and linear actuators are well known and appreciated by those skilled in the art. It is appreciated that the functions implemented by the processor 100 may be embodied in hardware (including an application specific integrated circuit (ASIC), a field programmable gate array (FPGA), etc. and/or software, including firmware, software, micro-code, etc.) Further, it is appreciated that the processor 100 may be a part of a controller or be a separate device such as schematically illustrated in FIG. 6, or may be a part of an overall device controller. It is appreciated that the processor is programmed to perform one or more gasification processes. The processor may include multiple programs for dealing with various types of biomass and waste products. In one embodiment, a substantial portion of the programming may revolve around temperature in the gasifier. For example, some processes may be effectively controlled by sensing the temperature in the primary chamber 16 and/or the heat transfer chamber 18 and controlling inlet air to the primary chamber 16 and/or controlling the amount of fuel burned by the burner 24. In other cases, a complete process may be programmed by programming specific temperature set points or target temperature points to be met over a period of time. In a gasification-combustion process, the process entails at least a phase of gasification followed by a phase of combustion. In the case of dealing with biomass for example, the gasification phase may involve heating the primary chamber 16 and the biomass in such a way as to cause the biomass to emit fumes or gases and in that process moisture is removed from the biomass. At a later point, once gasification is complete or substantially complete, the process moves to a combustion or carbon process. Here the biomass combusts and burns. In the gasification phase, the process is removing moisture from the biomass through volatization and produces gases. As discussed above, at a point in the process, combustion is reached and the biomass actually burns. During the gasification process the variable air flow vents are set such that a relatively small amount or no amount of air is induced into the primary chamber 16 via the openings 54 in the door 50. But once combustion is reached, more oxygen may be beneficial. Therefore the processor is programmed to adjust the airflow induced into the primary chamber 16 by controlling the actuator 108 which moves the slide bar 58 to a position where the opening 54 in the door are more open than during the preceding gasification phase. In one example, the processor is programmed to actuate the slide bar 58, shown in FIG. 6, in response to the temperature within the primary chamber 16 being equal to or greater than a certain temperature. For example, when the temperature in the primary chamber reaches a selected temperature, such as approximately 600° F., then this is an indication that the process is transitioning from a gasification process to a combustion process. The temperature threshold just referred to is based on hypotheses. It should be appreciated that further research and development may indicate other threshold temperature ranges. Furthermore, the temperature threshold range for converting from gasification to combustion may depend on many factors such as the nature and quantity of biomass or waste product being gasified. At this point, the controller actuates actuator 108 causing the slide bar to move to a position that will enable relatively more air and consequently oxygen to reach the primary chamber 16 and support the combustion process.

The gasifier 10 of the present invention can be utilized to dispose of biomass and other waste products in a clean and environmentally friendly way and without releasing harmful gases and toxins to the environment. In one application, the gasifier 10 is utilized to dispose a biomass through a gasification phase or process that is followed by a combustion or carbon process. In this case, the biomass is loaded into the primary chamber 16 and the door 50 is closed and forms an airtight sealed relationship with the primary chamber.

The burner 24 is fired and this begins the process. Generally, at the beginning of the gasification process more heat from the burner 24 may be required than is required during subsequent periods of the process. As described later, the biomass itself during the gasification process produces fuel that is burned and exothermic reactions that supply heat to the gasification process.

During the gasification process the burner 24 heats incoming air that passes into the gasifier through the air inlet associated with the burner as well as the air that enters via the auxiliary air inlet 82. The air heated by the burner 24 is directed down the vertical heating chamber 20 and into the heat transfer chamber 18. The heat transfer chamber 18 heats the overlying conductive floor 40 that supports the biomass. As the temperature increases in the primary chamber 16, portions of the biomass begin to volatize, creating fumes that include constituents that include hydrogen-carbon bonds and other bonds. The primary chamber 16 operates at a negative or reduced pressure relative to the heat transfer chamber 18. The fumes generated in the gasification process in the primary chamber 16 move through the opening 42 in the back wall of the primary chamber and pass into the vertical heating chamber. Here the resulting fumes are mixed with the inlet heated air that is directed into the vertical chamber 20. As the fumes move downwardly through the vertical heating chamber 20 towards the heat transfer chamber 18, the bonds of the various compounds tend to breakdown and oxidize and produce an exothermic reaction. This reaction releases heat and this additional heat is utilized to heat the heat transfer chamber 18 and ultimately the primary chamber 16.

The heat released by these exothermic reactions can result in the temperature within the heat transfer chamber 18 reaching approximately 800-1000° C. As the fumes from the biomass generate more and more exothermic energy, the fuel supply to the burner 24 can be decreased because more and more of the energy required to carry out the gasification process is provided by the biomass itself. The processor and control system shown in FIG. 6 can be programmed to receive sensed temperature signals from various parts of the gasifier 10 and to control the supply of fuel and air to the burner 24 so as to provide an appropriate amount of fuel to maintain programmed temperature conditions within the primary chamber 16 and heat transfer chamber 18 in order to maintain an effective and efficient gasification process.

In addition, the temperature within the primary chamber 16 can be controlled directly by modulating a fuel supply valve that supplies fuel to the burner 24. In addition, the air flow control vents provided on the door 50 can be adjusted to increase the flow of inlet air directly into the primary chamber 16 via the vents provided in the door. Generally, these vents are designed to provide a relatively low volume of air into the primary chamber during certain phases of the gasification process. As is appreciated, by allowing a relatively small amount of air to be directed through these vents into the primary chamber 16 enables the temperature within the primary chamber to increase.

The heat transfer chamber 18 is communicatively connected with the vertical exhaust chamber 22 that extends upwardly through the gasifier 10 adjacent the back wall of the primary chamber 16. Thus during the process, a portion of the exhaust gases is directed from the heat transfer chamber 18 into the vertical exhaust chamber 22 and into the exhaust flue 60 which is communicatively connected with the vertical exhaust chamber of the gasifier. There are various ways to control the exhaust of gases from the gasifier. In one example, a damper such as a butterfly draft control can be strategically positioned to permit an appropriate amount of gases to be expelled from the gasifier via the exhaust flue 60. In one example, a butterfly draft control is utilized and this device uses a counter weight that is adjustable to control the draft of the gasifier.

Continuing to refer to the gasification process, after the burner 24 has been started, the heat transfer chamber 18 is heated and this causes the temperature to rise in the primary chamber 16. As the temperature in the primary chamber 16 increases this causes moisture to be released from the biomass. More particularly, portions of the biomass are volatized, producing the fumes discussed above. These are also exothermic reactions that produce heat. Thus, the exothermic reactions resulting from the biomass continue to heat up the heat transfer chamber 18 and that in turn results in the temperature in the primary chamber 16 increasing. This increased heat energy given off by the biomass is added to the energy supplied by the burner 24 to heat the heat transfer chamber 18. Again, it should be pointed out that by using temperature sensors such as thermocouples in the heat transfer chamber 18 of the primary chamber 16 and directing temperature control signals from these temperature sensors to the processor 100 shown in FIG. 6, the overall gasification and combustion process can be controlled in an effective and fuel efficient manner.

In any event, eventually the gasification process will reach a point where the biomass has been reduced to a point that combustion of the biomass occurs. Once the combustion or carbon phase of the process begins, the biomass itself begins to burn and generate a flame. The control system shown in FIG. 6 is programmed to adjust the variable airflow vents to allow more air to enter the primary chamber 16 to support the combustion process. Once the combustion process begins, the energy or heat required from the burner is substantially reduced compared to the initial stages of gasification and in some cases the burner 24 can be set at "low fire" or controlled at "low fire" during the combustion phase which makes the gasifier 10 very fuel efficient during the combustion phase.

The present invention provides a gasifier 10 that provides for a controlled gasification-combustion process for biomass and other waste products. The process carried out by the gasifier 10 is designed to minimize particulates in the fumes produced in the primary chamber and particulates that might be exhausted by the exhaust flue 60. More particularly, the process is designed to minimize the production of fly ash. Furthermore the gasifier 10 and the control system is designed to control and maintain a stable temperature in the primary chamber 16. In the end the process is environmentally friendly as the exhaust gases from the exhaust flue 60 contain little or no hydrocarbons, dioxins and other harmful gases or particulates. The present system and process is designed to dispose of the biomass or the waste product such that in the end all that remains is white ash that is generally free of carbon.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A gasifier for a gasifying biomass and other waste materials, comprising:

a primary chamber for receiving and holding waste to be gasified;

a heat transfer chamber disposed adjacent the primary chamber;

a burner for supplying heat to the gasifier and wherein the burner is operative to heat the heat transfer chamber which in turn heats the primary chamber and the waste therein;

the primary chamber is lined with at least two distinct groups of refractory brick having distinct durability and insulating characteristics;

the two different groups of refractory bricks including a first lower section of refractory bricks that comprise a lower portion of a primary chamber wall and a second upper section of refractory brick disposed over the first lower section of refractory brick and comprising a portion of the primary chamber wall;

wherein the first lower section of refractory brick are more resistant to wear and abrasion than the second upper section of refractory brick; and wherein the second upper section of refractory brick is both more porous and include better insulating qualities than the first lower section of brick.

2. The gasifier of claim 1 wherein the primary chamber includes an access opening and wherein there is provided a door movable between open and closed positions and wherein in the closed position the access opening is closed by the door; the primary chamber including a heat conductive floor that includes an upper surface; and wherein the primary chamber includes a retainer that forms a lower portion of the access opening; the retainer including a face plate that abuts the door when the door is in the closed position and an interior angled ledge that includes an angled surface that extends downwardly and inwardly towards the conductive floor and wherein the angled surface joins the upper surface of the conductive floor.

3. The gasifier of claim 2 wherein the retainer forms a triangular shaped block structure that extends across the lower front portion of the primary chamber.

4. The gasifier of claim 1 including an exhaust flue extending from the gasifier for directing exhaust gases from the gasifier; and a heat exchanger associated with the exhaust flue for heating fresh inlet air that is directed to the gasifier.

5. The gasifier of claim 4 wherein the exhaust flue includes an elongated conduit and wherein the heat exchanger includes a housing adjacent the exhaust flue and wherein there is an space or area defined between the housing and the exhaust flue for permitting inlet air to flow through the space prior to being directed into the gasifier.

6. The gasifier of claim 1 further including:

one or more adjustable air flow vents for varying the quantity of fresh air directed into the gasifier;

an actuator operatively connected to the one or more variable air vents for actuating the one or more variable air vents; and a processor operatively connected to the actuator for actuating the actuator which in turns actuates the one or more adjustable airflow vents.

7. The gasifier of claim 1 including a series of air inlets disposed in a wall or a door structure disposed adjacent the primary chamber; a sliding bar having a series of openings therein mounted adjacent the series of air inlets; and wherein the air inlets can be opened, closed or partially opened by sliding the bar back and forth across the air inlets.

8. The gasifier of claim 7 wherein the sliding bar is spring biased towards the air inlets.

9. The gasifier of claim 6 further including a temperature sensor disposed in the gasifier for sensing the temperature at a selected location in the gasifier; the temperature sensor being operatively connected to the processor and wherein the processor is operative, via the actuator, to adjust the adjustable airflow vents based on a temperature sensed by the temperature sensor.

10. The gasifier of claim 9 wherein the processor is operatively connected to the burner for controlling the burner.

11. The gasifier of claim 1 wherein the primary chamber includes a floor and a back wall and wherein there is provided a bumper that extends upwardly from the floor and transversely across a lower portion of the back wall.

* * * * *